US007402366B2

(12) United States Patent
Hayata et al.

(10) Patent No.: US 7,402,366 B2
(45) Date of Patent: Jul. 22, 2008

(54) ORGANIC PHOTORECEPTOR, PROCESS CARTRIDGE, IMAGE FORMING METHOD, AND IMAGE FORMING APPARATUS

(75) Inventors: Hirofumi Hayata, Fuchu (JP); Masao Asano, Tokyo (JP); Kazuhisa Shida, Hino (JP); Kunihiro Ogura, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 30 days.

(21) Appl. No.: 11/390,783

(22) Filed: Mar. 28, 2006

(65) Prior Publication Data

US 2006/0269857 A1 Nov. 30, 2006

(30) Foreign Application Priority Data

May 25, 2005 (JP) ..... 2005-152235
May 25, 2005 (JP) ..... 2005-152236

(51) Int. Cl.
*G03G 15/04* (2006.01)
*G03G 15/00* (2006.01)

(52) U.S. Cl. ..... 430/66; 430/60; 430/58.2; 430/59.6; 399/159

(58) Field of Classification Search ..... 430/59.6, 430/60, 63, 58.2, 66; 399/159
See application file for complete search history.

(56) References Cited

U.S. PATENT DOCUMENTS 5,334,477 A * 8/1994 Bugner et al. ..... 430/125.6
5,485,250 A * 1/1996 Kashimura et al. ..... 399/116
2005/0266328 A1 * 12/2005 Yanagawa et al. ..... 430/66

* cited by examiner

*Primary Examiner*—Mark F. Huff
*Assistant Examiner*—Peter L Vajda
(74) *Attorney, Agent, or Firm*—Lucas & Mercanti, LLP

(57) ABSTRACT

Disclosed is an organic photoreceptor possessing a photosensitive layer having a surface layer, provided on a conductive support, wherein the surface layer of the organic photoreceptor contains a block copolymer composed of a matrix component and a low surface energy component, and possesses a sea/island structure having domains formed by aggregating the low surface energy component in the block copolymer, and also disclosed are a process cartridge, an image forming method and an image forming apparatus, employing the foregoing organic photoreceptor.

14 Claims, 3 Drawing Sheets

ORGANIC PHOTORECEPTOR, PROCESS CARTRIDGE, IMAGE FORMING METHOD, AND IMAGE FORMING APPARATUS

This application claims priority from Japanese Patent Application Nos. 2005-152235 and 2005-152236 filed on May 25, 2005, which are incorporated hereinto by reference.

TECHNICAL FIELD

The present invention relates to an organic photoreceptor for use in an image formation of an electrophotographic method, and a process cartridge, an image forming method and an image forming apparatus employing the organic photoreceptor, and in more detail, to the process cartridge, the image forming method and the image forming apparatus employing the organic photoreceptor used in the field of a copying machine and a printer.

BACKGROUND

In recent years, electrophotographic copiers and printers come to be more often utilized in printing and color printing applications. In said printing and color printing applications, digital black and white images or color images having high image quality are strongly required. For this demand, it is proposed to form a high precision digital image by use of laser light having a short wavelength as an exposure light source (Patent Document 1). However, it is in a present situation that the resulting electrophotographic image has not achieved a sufficiently high quality image even though a dot latent image is formed on the organic photoreceptor via precise dot exposure.

One of the reasons lies in that even though a precise dot latent image is formed on an organic photoreceptor employing a semiconductor laser, the dot latent image can not be precisely reproduced as a toner image. In particular, the dot latent image formed by a semiconductor laser or others is reproduced as a toner image smaller or larger than a latent image in size, since a uniform surface property of the organic photoreceptor in the order of a micron dimension can not be obtained, resulting in no formation of a microscopically uniform toner image, and problems are easily produced such that transfer hollow defects (hereinafter, referred simply to as hollow defects) are generated, resulting in lowered image density, since the toner image formed on the photoreceptor is not sufficiently transferred into a transfer medium (being a transfer material or an intermediate image transfer body such as paper sheets and so forth).

Proposed as a method to improve the surface property of the organic photoreceptor is an organic photoreceptor containing fluorine-containing resin particles on the photoreceptor surface (Patent Document 2). The organic photoreceptor containing these fluorine-containing resin particles exhibits an anti-toner filming property as well as a surface anti-stain property, but fluorine-containing resin particles are difficult to be dispersed in the order of a micron dimension in a binder resin, and the fluorine-containing resin particles and the binder resin are separated at the micron size level, whereby blurred images are easily generated. Another problem is also produced such that scratches are easily generated on the surface layers of fluorine-containing resin particles because of an insufficient wear resistance property of the surface layer, whereby scratches are easily generated in halftone images.

(Patent Document 1) Japanese Patent O.P.I. Publication No. 2001-255685

(Patent Document 2) Japanese Patent O.P.I. Publication No. 8-328287

The present invention was conducted to solve the foregoing problems. It is an object of the present invention to provide an organic photoreceptor in which a dot latent image formed on an organic photoreceptor employing an imagewise exposure light source of a semiconductor laser can be precisely reproduced onto the organic photoreceptor as a toner image, and the reproduced toner image is assuredly transferred into a transfer medium, and also to provide the organic photoreceptor accompanied with a process cartridge, an image forming method and an image forming apparatus employing the organic photoreceptor, in which an improved cleaning ability is obtained, transferability of a toner image on the organic photoreceptor into a transfer medium is also improved, generation of hollow defects as well as degraded dot images can be inhibited, and the surface layer exhibiting an improved cleaning ability can also be obtained.

SUMMARY

Disclosed is an organic photoreceptor possessing a photosensitive layer having a surface layer, provided on or over a conductive support, wherein the surface layer of the organic photoreceptor contains a block copolymer composed of a matrix component (component A) and a low surface energy component (component B), and possesses a sea/island structure having domains formed by aggregating the low surface energy component in the block copolymer.

BRIEF DESCRIPTION OF THE DRAWINGS

Embodiments will now be described, by way of example only, with reference to the accompanying drawings which are meant to be exemplary, not limiting, and wherein like elements numbered alike in several figures, in which.

DETAILED DESCRIPTION OF THE INVENTION

Figure 1:
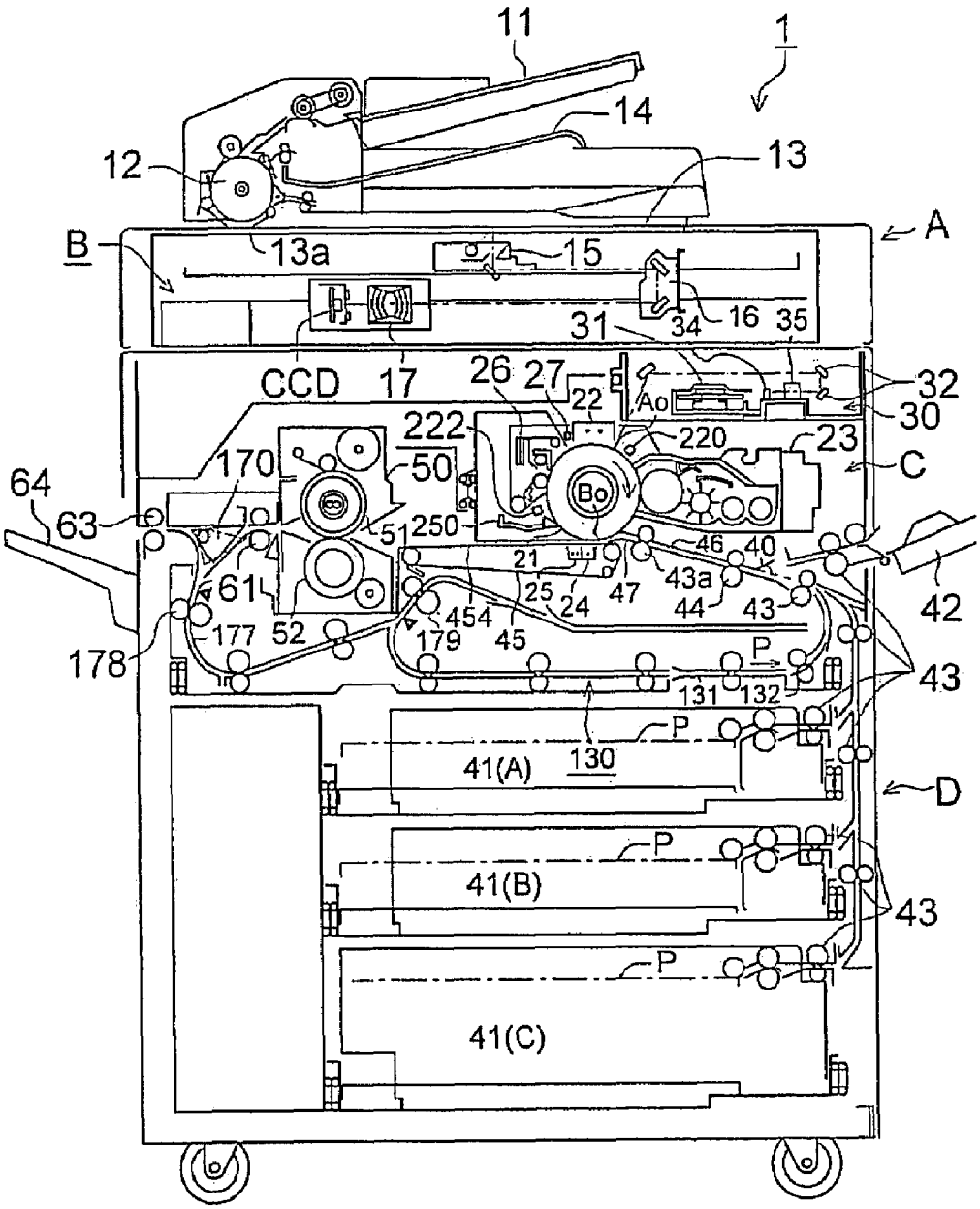
FIG. 1 is a schematic view showing incorporated functions of the image forming apparatus of the present invention.

After considerable effort to solve the above-described problems, the present invention has been accomplished by finding out that a technique is desired to be developed, in which a dot latent image formed on an organic photoreceptor employing an imagewise exposure light source of a semiconductor laser can be precisely formed into a toner image, the precisely formed toner image is assuredly transferred from the organic photoreceptor to a transfer medium, the uniform surface of the organic photoreceptor in the order of a micron dimension as well as the uniform surface property at a low surface energy state can be obtained, and the surface layer exhibiting an excellent cleaning property is also acquired.

It is a feature that an organic photoreceptor of the present invention possesses a photosensitive layer having a surface layer, provided on or over a conductive support, wherein the surface layer of the organic photoreceptor contains a block copolymer composed of a matrix component and a low surface energy component, and possesses a sea/island structure having domains formed by aggregating the low surface energy component in the block copolymer.

By providing an organic photoreceptor of the present invention having the above structure, a dot latent image can be changed to form a precise dot image employing a semiconductor laser, and toner image transferability from a photoreceptor to a transfer medium is improved, whereby not only hollow defects and degradation of dot images are inhibited, but also a cleaning ability is improved to provide electrophotographic images.

A usable organic photoreceptor of the present invention contains a block copolymer composed of both components of a matrix component block and a block having a low surface energy component forming domains via aggregation.

Domains formed by aggregating a low surface energy component in a block copolymer mean that exhibited is a structure in which a matrix component made of a styrene-acrylic resin or polycarbonate as a block copolymer forms a base material region (being a sea region in the sea/island structure), and polysiloxane as the low surface energy component is aggregated in the base material region made from the matrix component to form domains, whereby the domains are dispersed in the surface layer.

A low surface energy component is a component capable of being at a low surface energy state, and a contact angle with respect to pure water (at 20° C.) of a film prepared only with the low surface energy component exhibits a higher property than that of a contact angle with respect to pure water (at 20° C.) of a film formed only with the matrix component. It is preferable that the contact angle is a 10° higher contact angle.

Herein, a measuring method of the contact angle of an organic photoreceptor is described.

Measurement of Contact Angle and its Variation

The contact angle on the photoreceptor surface is obtained by measuring the contact angle with respect to pure water using an automatic contact angle meter (special roll type CA-W model, produced by Kyowa Interface Science Co., Ltd.) at 23° C. and 50% RH. In order to achieve a good balance between measurement stability and change of measured values depending on evaporation of water, measurement is to be terminated within 5-30 seconds after dripping water droplets. Contact angle θ is measured via the θ/2 method. Though the contact angle does not vary usually in the case of within a regular amount of water droplets, measurement is carried out from the direction normal to the direction of the drum axis in the case of a photoreceptor drum, and the amount of water droplets is set to 70 μl, since the deviation to the drum curvature is neglected. Measurement is carried out at the time when a surface energy lowering agent is sufficiently added into the surface of a photoreceptor conformed to the image formation in the case of a coat supplied from the exterior, or of an initial photoreceptor in the case of adding in the layer of a photoreceptor. Measurement is conducted at three positions at the center and 5 cm from the right and left ends of a cylindrical photoreceptor, and at four positions measured at each 90° in the circumferential direction; i.e. at a total of 12 positions. The average of these measurements is assumed as a contact angle, and the values farthest from this average value in the positive and negative directions are assumed as variations.

Examples of polymer components forming the above matrix component include a polystyrene component, a polystyrene acrylic component, a polycarbonate component, a polyester component, a polyarylate component, and a polyurethane component, as polymer components employed as a binder resin used for an organic photoreceptor. Of these, a polystyrene acrylic component and a polycarbonate component are preferable.

Unless polymer components of these matrix components contain a low surface energy component, they may be either block polymer or graft polymer, and cross-linking components may also be contained in these components.

On the other hand, as a low surface energy component, a polysiloxane component, an alkylfluoride polymer component, a higher fatty acid hydrocarbon group component and such are preferable. Of these, a polysiloxane component is most preferable. Examples of a polysiloxane component include dimethyl polysiloxane, methylhydrogenpolysiloxane, phenylmethyl polysiloxane, and so forth. An example as an alkylfluoride polymer component is one containing a perfluoroalkyl component. Examples of a higher fatty acid hydrocarbon group component include a caproic acid, a caprylic acid, a capric acid, a lauric acid, a myristic acid, a palmityl acid, a stearic acid, and a behenic acid.

It is also preferable that a low surface energy component is bonded only to the mono-terminal of a block copolymer.

By providing a low surface energy component bonded only to the mono-terminal of a block copolymer, a dot latent image can be changed to form a precise dot image employing a semiconductor laser, and toner image transferability from a photoreceptor to a transfer medium is improved, whereby not only hollow defects and degradation of dot images are inhibited, but also a cleaning ability is improved to provide electrophotographic images.

As graft polymer (GP1) described hereinafter, a polymer containing a comb type structure polysiloxane group, in which a lot of (at least three) polysiloxanes as low surface energy components are bonded, is not capable of forming domains on the surface layer.

A commonly known synthesis method is provided as a synthesis method of a binder resin composed of a matrix component and a low surface energy component. Based on an example of radical polymerization, the following azo group-containing polydimethylsiloxane is employed as an initiator. A monomer component such as acrylic ester, styrene or such is dissolved with this initiator in a solvent to prepare A-B type copolymerizable block polymer of a polystyrene-acrylic block and polydimethylsiloxane (A-B type copolymerizable block polymer to which polymethylsiloxane is bonded only at mono-terminal).

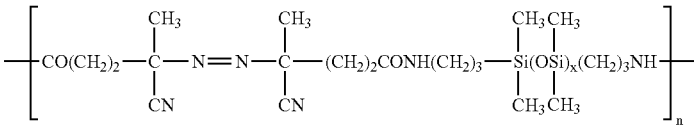

Two kinds of the above azo group-containing polydimethylsiloxane such as VSP0501 (the number average molecular weight of polydimethylsiloxane: 5000) and VSP1001 (the number average molecular weight of polydimethylsiloxane: 10000), produced by Wako Pure Chemicals Ind. Ltd., are available in the market.

Regarding a block polymer synthesis method with a condensed polymer such as polycarbonate and so forth, an A-B type copolymerizable block polymer of usable polycarbonate block and polydimethylsiloxane in the present invention (A-B type or B-A-B type copolymerizable block polymer to which polymethylsiloxane is bonded only at mono-terminal or at bi-terminals) can be prepared by employing a commonly known block copolymerization synthesis method.

Specifically, employing a bisphenol compound alkaline solution such as 2,2-bis(4-hydroxy-3-methylphenyl)propane and so forth, a polycarbonate oligomer methylene chloride solution is prepared by a phosgene method, and then a block copolymer having polymethylsiloxane at the polycarbonate terminal can be produced by mixing the polycarbonate oligomer methylene chloride solution, 2-benzoyl-5-(3-polydimethylsiloxane propoxy) phenol and antioxidant 4-tert-butylphenol (PTBT), and further adding sodium hydroxide or such.

The block copolymer having a matrix component and a low surface energy component relating to the present invention can be prepared via the above synthesis method. An example of copolymers preferably used in the present invention is provided below.

TABLE 1

| | Matrix component | Low surface energy component | Total molecular weight (Mn) | Molecular weight of low surface energy component (Mn) | Content ratio of low surface energy component (% by weight) |
|---|---|---|---|---|---|
| Block 1 | St-MMA (6.5/3.5) copolymerization | Dimethyl poly siloxane | 18500 | 5000 | 3 |
| Block 2 | St-MMA (6.5/3.5) copolymerization | Dimethyl poly siloxane | 18500 | 5000 | 15 |
| Block 3 | St-MMA (6.5/3.5) copolymerization | Dimethyl poly siloxane | 18500 | 5000 | 35 |
| Block 4 | St-MA (6.5/3.5) copolymerization | Dimethyl hydrogen poly siloxane | 18500 | 10000 | 20 |
| Block 5 | Polycarbonate (DM) | Dimethyl poly siloxane | 18500 | 5000 | 15 |
| Block 6 | Polycarbonate (Z) | Dimethyl poly siloxane | 18500 | 5000 | 25 |
| Block 7 | Polycarbonate (DM-Z) | Dimethyl poly siloxane | 18500 | 10000 | 15 |
| Block 8 | St-MMA (6.5/3.5) copolymerization | Phenyl methyl siloxane | 15000 | 10000 | 35 |
| Block 9 | St-MMA (6.5/3.5) copolymerization | Perfluoro alkyl | 14000 | 2000 | 25 |
| Block 10 | Polycarbonate (Z) | Perfluoro alkyl | 18000 | 2000 | 30 |
| Block 11 | St-MMA (6.5/3.5) copolymerization | Stearic acid | 14000 | 283 | 15 |
| Block 12 | Polycarbonate (Z) | Stearic acid | 14000 | 283 | 20 |
| Block 13 | St-MMA (6.5/3.5) copolymerization | Behenic acid | 14000 | 340 | 15 |
| Block 14 | Polycarbonate (Z) | Behenic acid | 18000 | 340 | 20 |

In Table 1, St designates styrene, MMA designates methylmetaacrylate, and MA designates methylacrylate.

Polycarbonates having the following structures are polycarbonate (DM), polycarbonate (Z), and polycarbonate (DM-Z) as listed in Table 1.

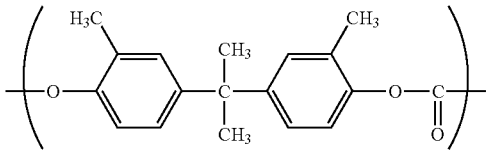

Polycarbonate (DM)

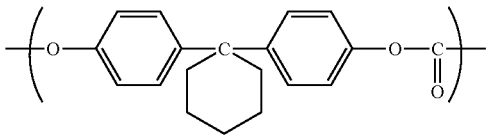

Polycarbonate (Z)

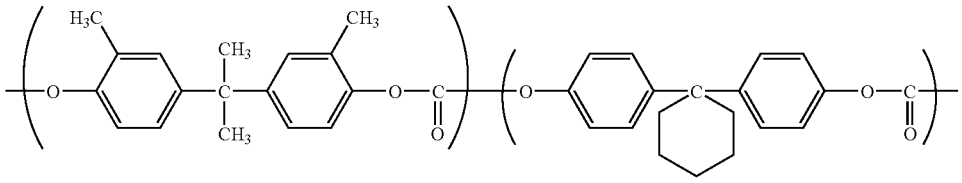

Polycarbonate (DM-Z)

The content ratio of low surface energy component (% by weight) in Table 1 means the content ratio of low surface energy component (% by weight), based on the total content of block copolymer.

Blocks 1-4 and 11-14 are block copolymers to which the entire low surface energy components are bonded only at mono-terminals, and components both at mono-terminals and bi-terminals are also confirmed in blocks 5-10 [via nuclear magnetic resonance (NMR) data analysis].

The surface layer of the present invention forms domains having a number average primary particle diameter of 1-100 nm after aggregating the above low surface energy component in the course of the surface layer formation, and is composed of a structure in which the domains are dispersed in a matrix of a styrene-acrylic resin component or others. It is preferable that the domain diameter is to be a number average primary particle diameter of 1-100 nm. In the case of a number average primary particle diameter of less than 1 nm, no improved effects of contact angle last and improved effects of the surface tend to be lowered. On the other hand, in the case of a number average primary particle diameter exceeding 100 nm, hollow defects are easily generated, since the surface layer is difficult to be microscopically placed at a low surface energy state, and toner image transferability from an organic photoreceptor to a transfer medium becomes partially insufficient. In the case of a domain diameter exceeding 100 nm, a blurred image and scratches tend to be also generated on a halftone image.

It is preferable that a molecular weight of component B is smaller that of component A in the component A-B block polymer. The number average molecular weight according to a polymerization degree of component A in terms of conversion is preferably 0.5-300000, and the number average molecular weight of component B is preferably 200-20000, but more preferably 500-15000.

The number average molecular weight of component A or B of an A-B type or a B-A-B type block copolymer in the present invention is determined via a molecular weight distribution measured by a GPC.

Herein, the method for measuring the molecular weight of resins, employing a GPC, is as follows. Added to 1 ml of THF is a measured sample in an amount of 0.5 to 5.0 mg (specifically, 1 mg), and is sufficiently dissolved at room temperature while stirring employing a magnetic stirrer and the like. Subsequently, after filtering the resulting solution employing a membrane filter having a pore size of 0.45-0.50 μm, the filtrate is injected in a GPC.

Measurement conditions of GPC are described below. A column is stabilized at 40° C., and THF is flowed at a rate of 1 ml per minute. Then measurement is carried out by injecting approximately 100 μl of the sample at a concentration of 1 mg/ml. It is preferable that commercially available polystyrene gel columns are combined and used. For example, it is possible to cite combinations of Shodex GPC KF-801, 802, 803, 804, 805, 806, and 807, produced by Showa Denko Co., combinations of TSKgel G1000H, G2000H, G3000H, G4000H, G5000H, G6000H, G7000H, TSK guard column, and the like, produced by Tosoh Corporation. Further, as a detector, a refractive index detector (IR detector) or a UV detector is preferably employed. When the molecular weight of samples is measured, the molecular weight distribution of the sample is calculated employing a calibration curve which is prepared employing monodispersed polystyrene as standard particles. Approximately ten polystyrenes samples are preferably employed for determining the calibration curve.

Next, the structure of an organic photoreceptor of the present invention will be described. In order to form domains having a number average primary particle diameter of 1-100 nm with component B aggregated on the surface layer, employing the above component A-B block polymer, it is preferable that a content ratio of component B to component A-B block polymer is at least 5.1% by weight, and a block copolymer of at most 45% by weight is employed. When the content ratio of component B to component A-B block polymer is less than 5.1% by weight, it is difficult to form a domain structure with component B aggregated on the surface layer, and also when a content of block copolymer exceeds 45% by weight, a wear resistance property of the surface layer tends to be degraded.

It is further preferable that the polymer component such as component B siloxane or such has a comparatively low polymerization degree with approximately 10-1000 repetition structure. When component B polymer structure is excessively large, component B is difficult to be aggregated, and the domain structure is hardly formed.

It is also considerable to select a solvent for dissolving the above A-B block polymer to form the surface layer. It is preferred that a good solvent (solvent to dissolve a matrix component sufficiently) is selected as the above block polymer matrix component, and is employed as a solvent coated on the surface layer. Solvents such as tetrahydrofran, toluene and the like, for example, are preferable.

By forming the surface layer under such the condition, formed can be the surface layer on which the domain structure having component B is formed in the matrix structure (referring to "sea") composed of a binder component as component A.

The number average primary particle diameter of domains in the present invention is determined by observing a cross-sectional sectional surface cut in the direction normal to the surface layer at magnification of 100,000 employing a transmission electron microscope. Random 100 particles are observed as primary particles (micrographs taken, if desired), and the number average diameter of the Feret diameter is obtained by image analysis in this measurement.

Similarly to domain density, the number of domains per a cross-section of "100 nm×100 nm" is determined via the above magnifying observation.

It is preferable that the surface layer of the present invention has a domain density of 2-10000 domains per 10000 $nm^2$ in cross-section. The surface of a photoreceptor results in remaining in a low surface energy state via presence of domains in such the density, whereby toner filming is inhibited, toner image transferability from a photoreceptor to a transfer medium is improved, and image defects such as hollow defects and so forth are also inhibited.

A layer structure other than the above-mentioned surface layer will be explained below.

The organic photoreceptor refers to as an organic photoreceptor equipped with at least one of a charge generating function essential to the configuration of the organic photoreceptor, and a charge transport function. It includes all the photoreceptors composed of the commonly known organic charge generating substances or organic charge transfer substances, and the known organic photoreceptors such as the photoreceptor wherein the charge generating function and charge transfer function are provided by the high-molecular complex.

There is no restriction to the configuration of the photoreceptor according to the present invention, provided that the photoreceptor possesses a surface layer having a sea-island structure in which domains having a number average primary particle diameter of 1-100 nm via accumulation of a low surface energy component in a binder resin. It includes, for example, the following configurations:

(1) A configuration wherein the photosensitive layer consists of a charge generating layer and charge transporting layer laid sequentially one on top of the other on a conductive support.

(2) A configuration wherein the photosensitive layer consists of a charge generating layer and the first and second charge transporting layers laid sequentially one on top of another on a conductive support.

(3) A configuration wherein the photosensitive layer consists of a single layer containing a charge transport material and a charge generating material laid on a conductive support.

(4) A configuration wherein the photosensitive layer consists of a charge transporting layer and charge generating layer laid sequentially one on top of the other on a conductive support.

(5) A configuration of the photoreceptor described in the aforementioned (1)-(4), wherein a surface protective layer is further provided.

The photoreceptor can be made in any one of the aforementioned configurations. The surface layer of the photoreceptor is the layer in contact with the air boundary. When a single layer photosensitive layer alone is formed on the conductive support, this photosensitive layer corresponds to the surface layer. When a single layer or a laminated photosensitive layer and surface protective layer are laid on the conductive support, the surface protective layer serves as an extreme surface layer. In the present invention, the configuration (2) is most preferably used. In the photoreceptor of the present invention, the substrate layer may be formed on the conductive support, prior to the formation of the photosensitive layer, independently of the type of configuration adopted.

The charge transporting layer of the present invention can be defined as a layer having a function of transporting the electric charge carrier generated on the charge generating layer due to light exposure, to the surface of the organic photoreceptor. Specific detection of the electric charge transport function can be confirmed by laying the charge generating layer and charge transporting layer on the conductive support, and by detecting the photoconductivity.

The following describes a specific configuration of the photosensitive layer, with reference to an example of the layer configuration (2) that is most preferably used in the present invention:

Conductive Support:

A sheet-like or cylindrical conductive support is used as the conductive support used for the photoreceptor of the present invention.

The cylindrical conductive support of the present invention can be defined as a cylindrical support desired to form images on an endless basis through rotation. The preferred cylindricity is 5-40 μm, and the more preferred one is 7-30 μm.

The cylindricity is based on the JIS (B0621-1984). To be more specific, when a cylindrical substrate is sandwiched between two coaxial geometrical cylinders, the cylindricity is expressed in terms of the difference of the radii at the position where a space between two coaxial cylinders is minimized. In the present invention, the difference in the radii is expressed in "μm". The cylindricity is gained by measuring the roundness at a total of seven points—two points 10 mm from both ends of the cylindrical substrate, a center, and four points obtained by dividing the space between both points and the center into three equal parts. A non-contact type universal roll diameter measuring instrument (by Mitsutoyo Co., Ltd.) can be used for this measurement.

The conductive support may consist of a metallic drum made of aluminum, nickel or the like, a plastic drum formed by vapor deposition of aluminum, tin oxide, indium oxide or the like, or a paper/plastic drum coated with conductive substance. The conductive support is preferred to have a specific resistance of $10^3$ Ωcm or less at the normal temperature.

A conductive support wherein the alumite film provided with porous sealing treatment on the surface is formed may be used in the present invention. Alumite treatment is normally carried out in the acid bath containing a chromium oxide, sulfuric acid, oxalic acid, phosphoric acid, sulfamic acid or others. In sulfuric acid, the best result is obtained by anodization. In the case of anodization treatment in sulfuric acid, preferred conditions include a sulfuric acid concentration of 100-200 g/l, aluminum ion concentration of 1 through 10 g/l, liquid temperature of around 20° C., and applied voltage of about 20 volts, without the preferred conditions being restricted thereto. The average thickness of the film formed by anodization is normally equal to or smaller than 20 μm, and is preferred to be equal to or smaller than 10 μm, in particular.

Intermediate Layer:

An intermediate layer accompanied with a barrier function can be provided between the conductive support and photosensitive layer in the present invention.

To improve the adhesion between the conductive support and photosensitive layer and to avoid injection of electric charge from the support, an intermediate layer (including the substrate layer) can be provided between the support and photosensitive layer in the present invention. The intermediate layer is made of a polyamide resin, polyvinyl chloride resin, vinyl acetate resin or copolymer resin including two or more recurring units of these resins. Polyamide resin is a preferred material as the resin where the residual potential increased by the repeated use of these substrate resins can be reduced. The preferable film thickness of the intermediate layer using these resins is 0.01-0.5 μm.

The intermediate layer preferably used in the present invention includes the intermediate layer made of the metallic resin created by thermosetting the organic metal compounds such as silane coupling agent and titanium coupling agent. The preferable film thickness of the intermediate layer is 0.1-2 μm.

The intermediate layer preferably used in the present invention includes the one obtained by dispersing the inorganic particles in the binder resin. The preferable number average diameter of the inorganic particles is 0.01-1 μm. The particularly preferred one is the intermediate layer obtained by dispersing the N-type semiconducting particles in the binder. It can be exemplified by the intermediate layer prepared by dispersing the titanium oxide in the polyamide resin, wherein this titanium oxide has been subjected to silica/alumina treatment and surface treatment by silane compound, and has a number average particle diameter of 0.01-1 μm. The preferable film thickness of the intermediate layer is 1-20 μm. The number average particle diameter is measured as a number average value of the Feret diameter by image analysis, after one hundred particles are randomly selected as primary particles from the observed particles via magnification of a factor of 100,000 employing a transmission electron microscope (micrographs taken, if desired).

The N-type semiconducting particles refer to the ones that convert conductive carriers into electrons. Converting conductive carriers into electrons refers to the property of effectively blocking the hole injection from the substrate by containing the N-type semiconducting particles in the insulating binder, without blocking the electron from the photosensitive layer.

The following describes the method of identifying the N-type semiconducting particles.

An intermediate layer having a film thickness of 5 μm (intermediate layer formed by using a dispersion consisting of 50% by weight of particles dispersed in the binder resin constituting the intermediate layer) is formed on the conductive support. This intermediate layer is negatively charged and the light damping property is evaluated. Further, it is positively charged, and the light damping property is evaluated in the same manner.

The N-type semiconducting particles are defined as the particles dispersed in the intermediate layer in cases where the light damping property, when negatively charged in the aforementioned evaluation, is greater than that when positively charged.

The aforementioned N-type semiconducting particles include the particles of titanium oxide ($TiO_2$), zinc oxide (ZnO) and tin oxide ($SnO_2$), and the titanium oxide is preferably used in the present invention.

The number average primary particle diameter is preferably 10 nm or more without exceeding 500 nm, more preferably 10 through 200 nm, and particularly preferably 15 nm through 50 nm.

The intermediate layer using the N-type semiconducting particles where the number average primary particle diameter is within the aforementioned range permits dispersion in the layer to be made more compact, and is provided with sufficient potential stability and black spot preventive function.

In the case of titanium oxide, for example, the number average primary particle diameter of the aforementioned N-type semiconducting particles is at a magnification of 100,000 times 10,000 by a transmission electron microscope. Random 100 particles are observed as primary particles, and a number average diameter of the Feret diameter is obtained by image analysis in this measurement.

The N-type semiconducting particles used in the present invention are configured in a branched, needle-shaped or granular form. These N-type semiconducting particles, for example, in the case of titanium oxide, are available in various crystal types such as anatase type, rutile structure and amorphous type. Any of these crystal types may be utilized. A combination of two or more crystal types may also be used. Of these types, the rutile type is particularly preferred.

In one of the methods for surface treatment by hydrophobing applied to the N-type semiconducting particles, surface treatment is carried out several times, and the last surface treatment operation in the surface treatment conducted several times is the one conducted by using a reactive organic silicon compound. It is preferred that at least one surface treatment operation in the process of surface treatment conducted several times should use the one using at least one of alumina, silica and zirconium. It is also preferred that the surface treatment using the reactive organic silicon compound should be conducted in the final operation.

Treatment by alumina, silica and zirconium refers to the treatment wherein alumina, silica and zirconium are deposited on the surface of the N-type semiconducting particles. The alumina, silica and zirconium deposited on the surface contain the hydrates of alumina, silica and zirconium. The surface treatment of reactive organic silicon compound is the treatment made by using the reactive organic silicon compound as a treatment solution.

As described above, uniform coating (surface treatment) of the surface of the N-type semiconducting particles is ensured by conducting surface treatment of the N-type semiconducting particles such as titanium oxide at least twice. If the N-type semiconducting particles having been subjected to surface treatment are used in the intermediate layer, it is possible to get a photoreceptor characterized by excellent dispersion property of the N-type semiconducting particles such as titanium oxide particles used in the intermediate layer, and by complete absence of an image defect such as a black spot.

Photosensitive Layer

An organic photoreceptor of the present invention has a photosensitive layer containing at least a charge generating material and a charge transporting material provided on or over a conductive support. The photosensitive layer may be composed of a layer in which the charge generating material and charge transporting material exist on the same layer, but preferable is a layer made of a multilayer structure of charge generating layer (CGL) containing the charge generating material and charge transporting layer (CTL) containing the charge transporting material. Next, an organic photoreceptor of the present invention, based on the multilayer structure will be explained.

Charge Generating Layer

Charge Generating Layer: A charge generating layer contains a charge generating material (CGM). In addition, the charge generating layer may contain a binder resin and other additives if desired.

Commonly known charge generating material (CGM) can be employed as charge generating material (CGM). Examples of charge generating material (CGM) include phthalocyanine pigments, azo pigments, perylene pigments, and azulenium pigments. Of these, CGM having a cube potential structure capable of producing a stable aggregated structure among plural molecules thereof is most effective to inhibit an increase of residual potential via repeated use. Specifically, CGM of a phthalocyanine pigment and perylene pigment each having a specific crystal structure are exemplified. For example, CGM of titanylphthalocyanine having a maximum peak of Bragg angle 2θ of diffraction of Cu—Kα X-ray at 27.2°, and benzimidazoleperylene having a maximum peak of the 2θ angle at 12.4° show almost no degradation via repeated use to make the residual potential minimized.

In the case of using a binder for the charge generating layer as a dispersion medium of CGM, a known resin can be employed as the binder, and examples of specific resins include most preferably a formal resin, a butyral resin, a silicone resin, a silicone modified butyral resin, and phenoxy resin. The ratio of the binder resin to the charge generating material is preferably 100 parts by weight of binder resin to a charge generating material of 20-600 parts by weight. Increase in residual potential via repeated use can be minimized by using these resins. The layer thickness of a charge generating layer is preferably 0.01-2 μm.

Charge Transporting Layer

As described above, it is preferred that the charge transporting layer is composed of plural charge transporting layers, and the surface layer structure of the present invention is also applied to the charge transporting layer as a top layer The charge transporting layer contains a charge transporting material (CTM) and a binder resin for dispersing the CTM, and may contain additives such as an antioxidant agent and the like if desired.

As charge transporting material (CTM), commonly known charge transporting material (CTM) of positive hole transportation type (P type) is preferably used. For example, a triphenylamine derivative, a hydrazone compound, a styryl compound, a benzidine compound, a butadiene compound can be employed. These charge transporting materials are usually dissolved in a proper binder resin to form a layer. Particularly, charge transporting materials which do not absorb a laser light wavelength of imagewise exposure are preferable.

As the binder resin used for charge transporting layer (CTL), any one of thermoplastic resin and thermosetting resin may be used. For example, polystyrene, an acrylic resin, a methacrylic resin, a vinyl chloride resin, a vinyl acetate resin, a polyvinyl butyral resin, an epoxy resin, a polyurethane resin, a phenol resin, a polyester resin, an alkyd resin, a polycarbonate resin, a silicone resin, a melamine resin range and a copolymer resin including more than repeating units of two resins among these resins may be usable. Further, other than these insulation resins, high polymer organic semiconductor such as poly-N-vinyl carbazole may be usable. The most preferred material is a polycarbonate resin in view of a smaller water absorption coefficient, CTM dispersibility, and electrophotographic characteristics.

The content ratio of binder resin is preferably 50-200 parts by weight to 100 parts by weight of charge transporting material. Total thickness of CTL is preferably at most 20 μm, and more preferably 10-16 μm. In the case of the thickness exceeding 20 μm, lowered sharpness and increased residual potential are easily generated because of a large amount of laser light absorption and scattering.

Moreover, it is preferable to contain an antioxidant provided on the surface layer of the present invention. When an antioxidant is introduced into the surface layer having a sea/island structure, in which domains are formed by aggregating a low surface energy component in a block copolymer, degradation of the surface layer and transfer characteristics, accompanied with a lowered cleaning property can be inhibited. The antioxidant is a material, as a typical one, having a character to prevent or control an action of oxygen under conditions, such as light, heat, and electric discharge, to an auto-oxidizing substance which exists in an organic photoreceptor or on the surface of an organic photoreceptor. Typically, the following groups of compounds are listed.

AO1-1

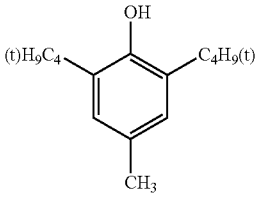

AO1-2

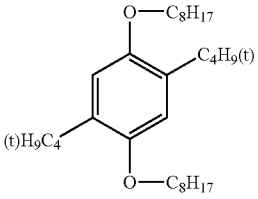

AO1-3

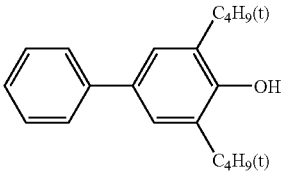

AO1-4

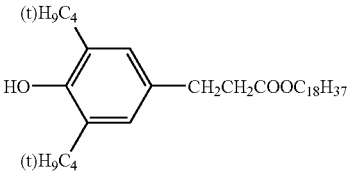

AO1-5

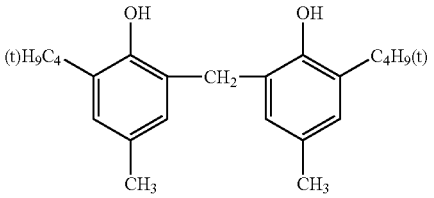

AO1-6

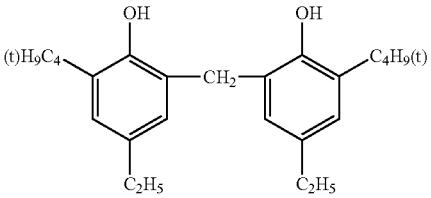

-continued
AO1-7
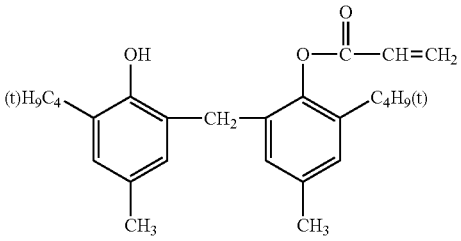
AO1-8
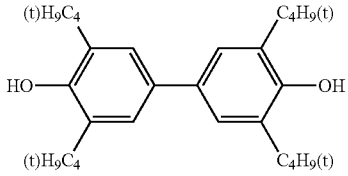
AO1-9
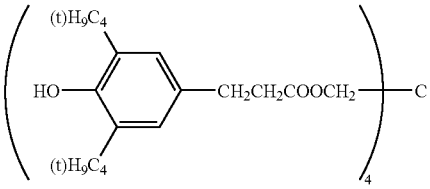
AO1-10
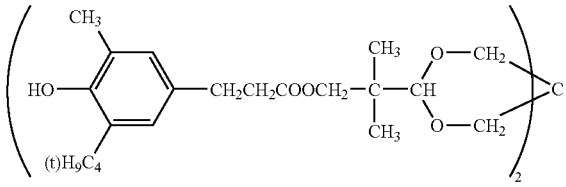
AO1-11
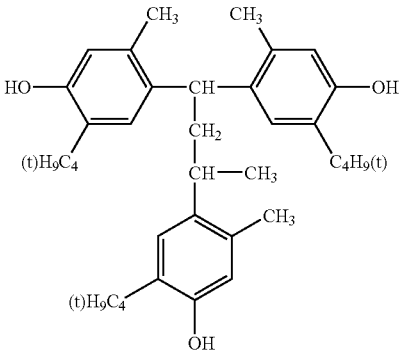
AO2-1
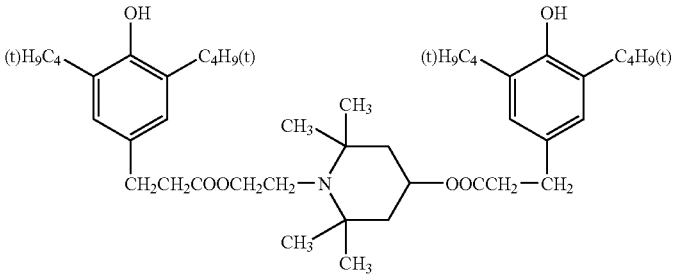
AO2-3
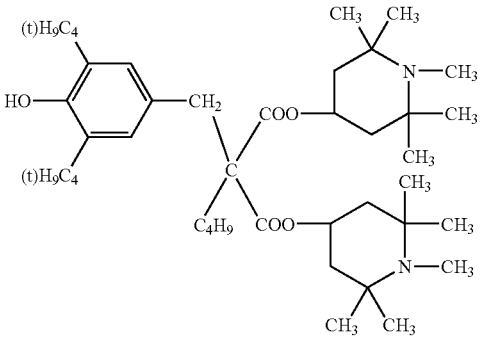
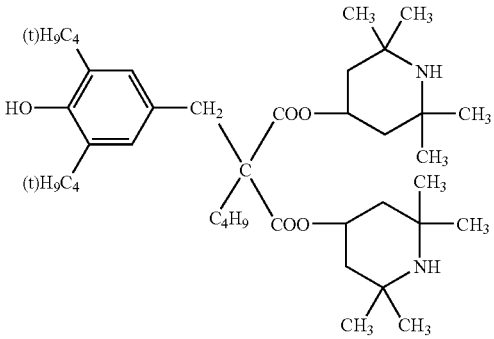

-continued

AO2-4

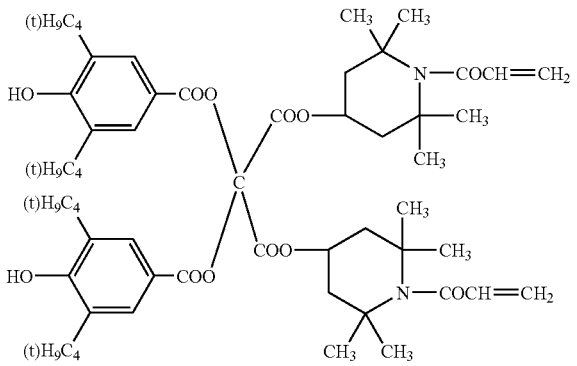

AO2-5

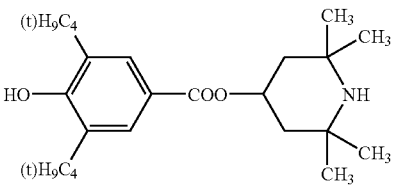

AO2-6

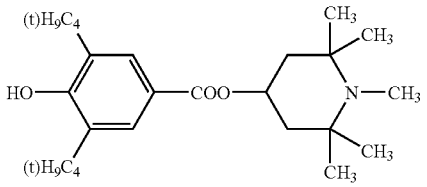

AO2-7

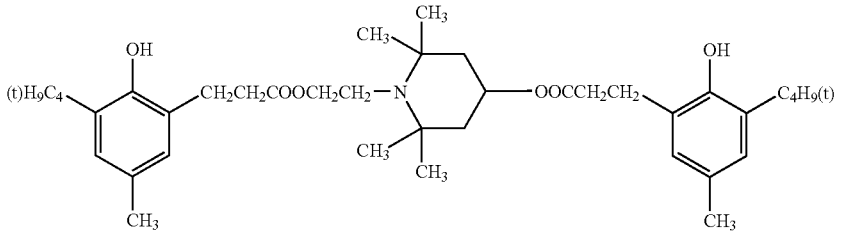

Examples of a solvent or a dispersion medium, used for forming an intermediate layer, a charge generating a charge transporting layer and such include n-butylamine, diethylamine, ethylenediamine, isopropanolamine, triethanolamine, triethylenediamine, N,N-dimethylformamido, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolan, dioxane, methanol, ethanol, butanol, isopropanol, ethyl acetate, butyl acetate, dimethyl sulfoxide and methyl cellosolve. The present invention is not limited thereto, but dichloromethane, 1,2-dichloro ethane and methyl ethyl ketone are preferably used. Further, these solvents or dispersion media may also be used either singly or as mixed solvents of at least two kinds.

The following describes the image forming apparatus employing an organic photoreceptor of the present invention:

Image forming apparatus 1 shown in FIG. 1 is a digital image forming apparatus. It includes image reading section A, image processing section B, image forming section C, and transfer paper conveyance section D as a transfer paper conveyance means.

An automatic document feed means for automatically feeding documents is arranged on the top of image reading section A. The documents placed on the document platen 11 as conveyed sheet by sheet employing document conveying roller 12, and the image is read at reading position 13*a*. The document having been read is ejected onto document ejection tray 14 by document conveying roller 12.

In the meantime, the image of the document placed on plate glass 13 is read by reading operation at speed v by first mirror unit 15 having an illumination lamp constituting a scanning optical system and a first mirror, and by the movement of second mirror unit 16 having the second and third mirrors located at the V-shaped position at speed v/2 in the same direction.

The scanned images are formed on the light receiving surface of image-capturing device (CCD) as a line sensor through projection lens 17. The linear optical images formed on image-capturing device (CCD) are sequentially subjected to photoelectric conversion into electric signals (luminance signals). Then they are subjected to analog-to-digital conversion, and then to such processing as density conversion and filtering in image processing section B. After that, image data is stored in the memory.

Image forming section C as an image forming unit comprises: drum-formed photoreceptor 21 as an image carrier; charging section (charging process) 22 for charging photoreceptor 21 on the outer periphery; potential detecting means 220 for detecting the potential on the surface of the charged photoreceptor; developing section (developing process) 23; transfer/conveyance belt apparatus 45 as a transfer section (transfer process); cleaning section (cleaning process) 26 for photoreceptor 21; and PCL (pre-charge lamp) 27 as an optical discharging section (optical discharging process). These components are arranged in the order of operations. Further, reflected density detecting section 222 for measuring the reflected density of the patch image developed on photoreceptor 21 is provided downstream from developing section 23. An organic photoreceptor of the present invention is used as photoreceptor 21, and is driven in the clockwise direction as illustrated.

Rotating photoreceptor 21 is electrically charged uniformly by charging section 22. After that, image exposure is performed based on the image signal called up from the memory of image processing section B by the exposure optical system as image exposure section (image exposure process) 30. In the exposure optical system as image exposure section 30 (also known as writing section), the optical path is bent by reflection mirror 32 through rotating polygon mirror 31, fθ lens 34, and cylindrical lens 35, using the laser diode (not illustrated) as a light emitting source, whereby main scanning is performed. Exposure is carried out at position Ao with reference to photoreceptor 21, and an electrostatic latent image is formed by the rotation (sub-scanning) of photoreceptor 21

In the image formation method of the present invention, when an electrostatic latent image is formed on the photoreceptor, a semiconductor laser or a light emitting diode can be employed as an image exposure light source. By making an exposure light dot diameter narrowed to 10-80 μm in a writing main scanning direction employing the above image exposure light source, and by conducting a digital exposure on an organic photoreceptor, it is possible to obtain an electrophotographic image having a high resolution of 400-2500 dpi (dpi: the number of dots per 25.4 cm).

The aforementioned exposure light dot diameter means a length of the exposure beam along with the writing main scanning direction in the area where the intensity of this exposure beam corresponds to $1/e^2$ of the peak light intensity (Ld: measured at the maximum length position.).

The exposure beam to be used includes the beams of the scanning optical system using the semiconductor laser and solid scanner such as an LED and the like. The distribution of the light intensity includes gauss distribution and Lorenz distribution. The portion exceeding $1/e^2$ of each peak intensity is assumed as an exposure light dot diameter of the present invention.

The electrostatic latent image on photoreceptor 21 is subject to reverse development by developing section 23, and a visible toner image is formed on the surface of photoreceptor 21. According to the image forming method of the present invention, polymerized toner is utilized as the developer for this developing section. An electrophotographic image of excellent sharpness can be achieved when the polymerized toner having a uniform shape and particle size is used in combination with the organic photoreceptor of the present invention.

In transfer paper conveyance section D, sheet feed units 41(A), 41(B) and 41(C) as a transfer sheet storage means are arranged below the image forming unit, wherein transfer sheets P having different sizes are stored. A manual sheet feed unit 42 for manual feed of the sheets of paper is provided on the side. Transfer sheets P selected by either of the two are fed along sheet conveyance path 40 by guide roller 43, and are temporarily suspended by sheet feed registration roller 44 for correcting the inclination and deviation of transfer sheets P. Then transfer sheets P are again fed and guided by sheet conveyance path 40, pre-transfer roller 43*a*, paper feed path 46 and entry guide plate 47. The toner image on photoreceptor 21 is transferred to transfer sheet P at transfer position Bo by transfer electrode 24 and separator electrode 25, while being carried by transfer/conveyance belt 454 of transfer/conveyance belt apparatus 45. Transfer sheet P is separated from the surface of photoreceptor 21 by separation claw unit 250 and is brought to fixing apparatus 50 as a fixing means by transfer/conveyance belt apparatus 45.

Fixing apparatus 50 contains fixing roller 51 and pressure roller 52. When transfer sheet P passes between fixing roller 51 and pressure roller 52, toner is fixed in position by heat and pressure. With the toner image having been fixed thereon, transfer sheet P is ejected onto ejection tray 64.

The above description is concerned with the case where an image is formed on one side of the transfer sheet. In the case of duplex copying, ejection switching member 170 is switched and transfer sheet guide 177 is opened. Transfer sheet P is fed in the direction of an arrow showed in a broken line.

Further, transfer sheet P is fed downward by conveyance device 178 and is switched back by sheet reversing section 179. With the trailing edge of transfer sheet P becoming the leading edge, transfer sheet P is conveyed into sheet feed unit 130 for duplex copying. In addition, numeral 61 is a guide roller.

Conveyance guide 131 provided on sheet feed unit 130 for duplex copying is moved in the direction of sheet feed by transfer sheet P. Then transfer sheet P is fed again by sheet feed roller 132 and is led to sheet conveyance path 40.

As described above, transfer sheet P is again fed in the direction of photoreceptor 21, and the toner image is transferred on the reverse side of transfer sheet P. After the image has been fixed by fixing section 50, transfer sheet P is ejected to ejection tray 64 through roller pair 63.

The image processing apparatus can be configured in such a way that the components such as the aforementioned photoreceptor, developing section and cleaning section are integrally combined into a process cartridge, and this unit is mounted on the apparatus proper as a removable unit. It is also possible to arrange such a configuration that at least one of the charging section, image exposure device, developing section, transfer electrode, separator electrode and cleaning section is supported integrally with the photoreceptor, so as to form a process cartridge that, as a removable single unit, is mounted on the apparatus proper, using a guide means such as a rail of the apparatus proper.

Figure 2:
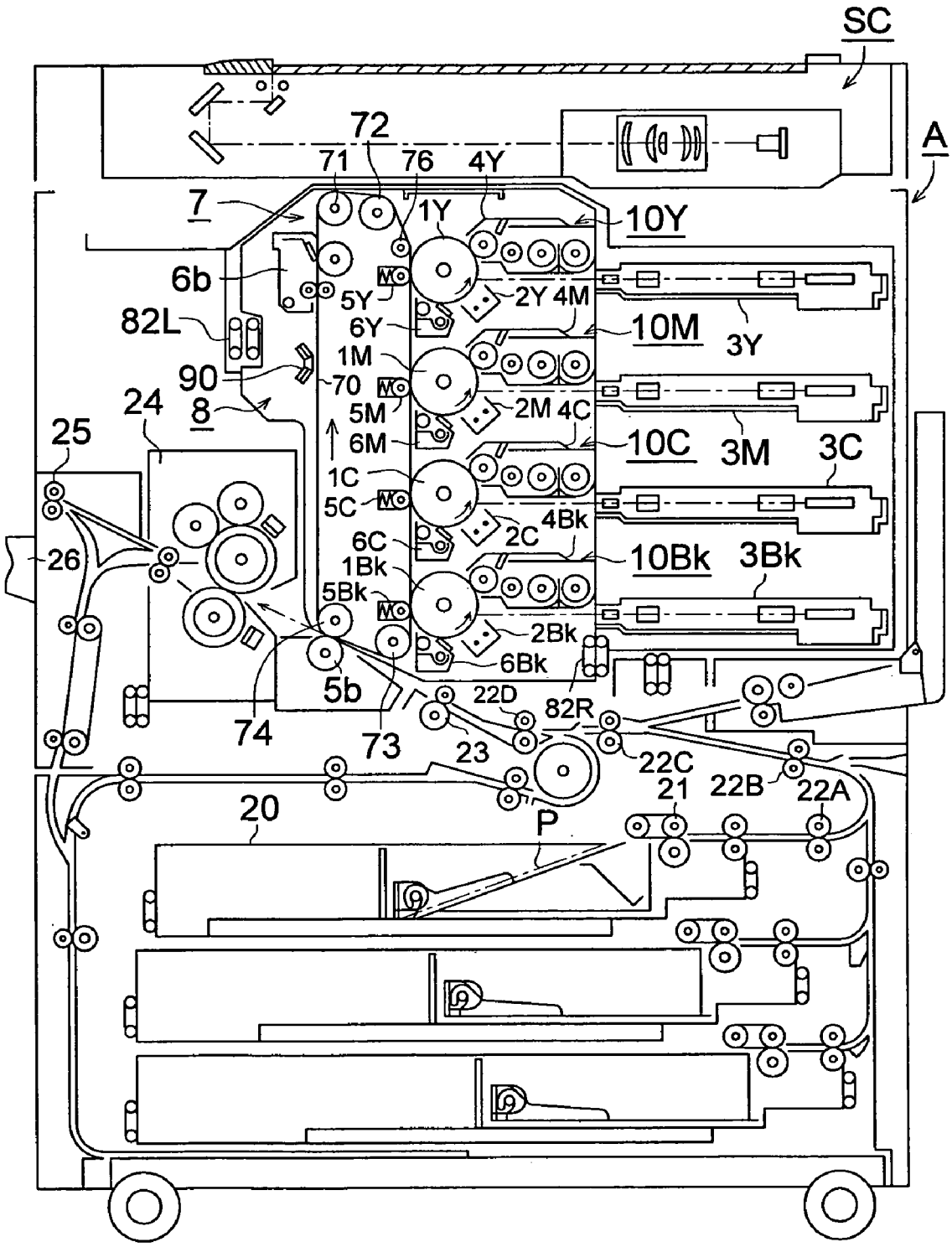
FIG. 2 is a sectional schematic view of a color image forming apparatus relating to one example of the present invention; and is a cross-sectional schematic view of a color image forming apparatus employing an organic photoreceptor.

FIG. 2 is a cross-sectional configuration view diagram of a color image forming apparatus showing a preferred embodiment of the present invention.

This color image forming apparatus is of the so called tandem type color image forming apparatus, and comprises four sets of image forming sections (image forming units) 10Y, 10M, 10C, and 10Bk, endless belt shaped intermediate image transfer body unit 7, sheet feeding and transportation means 21, and fixing means 24. The original document reading apparatus SC is placed on top of main unit A of the image forming apparatus.

Image forming section 10Y that forms images of yellow color comprises charging means (charging process) 2Y, exposing means (exposing process) 3Y, developing means (developing process) 4Y, primary transfer roller 5Y as primary transfer section (primary transfer process), and cleaning means 6Y all placed around drum shaped photoreceptor 1Y which acts as the first image supporting body. Image forming section 10M that forms images of magenta color comprises drum shaped photoreceptor 1M which acts as the first image supporting body, charging means 2M, exposing means 3M, developing means 4M, primary transfer roller 5M as a primary transfer section, and cleaning means 6M. Image forming section 10C that forms images of cyan color comprises drum shaped photoreceptor 1C which acts as the first image supporting body, charging means 2C, exposing means 3C, developing means 4C, primary transfer roller 5C as a primary transfer section, and cleaning means 6C. Image forming section 10Bk that forms images of black color comprises drum shaped photoreceptor 1Bk which acts as the first image supporting body, charging means 2Bk, exposing means 3Bk, developing means 4Bk, primary transfer roller 5Bk as a primary transfer section, and cleaning means 6Bk.

Four sets of image forming units 10Y, 10M, 10C, and 10Bk are constituted, centering on photosensitive drums 1Y, 1M, 1C, and 1Bk, by rotating charging means 2Y, 2M, 2C, and 2Bk, image exposing means 3Y, 3M, 3C, and 3Bk, rotating developing means 4Y, 4M, 4C, and 4Bk, and cleaning means 5Y, 5M, 5C, and 5Bk that clean photosensitive drums 1Y, 1M, 1C, and 1Bk.

Image forming units 10Y, 10M, 10C, and 10Bk, all have the same configuration excepting that the color of the toner image formed in each unit is different on respective photosensitive drums 1Y, 1M, 1C, and 1Bk, and detailed description is given below taking the example of image forming unit 10Y.

Image forming unit 10Y has, placed around photosensitive drum 1Y which is the image forming body, charging means 2Y (hereinafter referred to merely as charging unit 2Y or charger 2Y), exposing means 3Y, developing means 4Y, and cleaning means 5Y (hereinafter referred to merely as cleaning means 5Y or as cleaning blade 5Y), and forms yellow (Y) colored toner image on photosensitive drum 1Y. Further, in the present preferred embodiment, at least photosensitive drum 1Y, charging means 2Y, developing means 4Y, and cleaning means 5Y in image forming unit 10Y are provided in an integral manner.

Charging means 2Y is a means that applies a uniform electrostatic potential to photosensitive drum 1Y, and corona discharge type charger unit 2Y is being used for photosensitive drum 1Y in the present preferred embodiment.

Image exposing means 3Y is a means that carries out light exposure, based on the image signal (Yellow), on photosensitive drum 1Y to which a uniform potential has been applied by charging means 2Y, and forms the electrostatic latent image corresponding to the yellow color image, and an array of light emitting devices LEDs and imaging elements (product name: SELFOC LENSES) arranged in the axial direction of photosensitive drum 1Y or a laser optical system, etc., is used as exposing means 3Y.

Intermediate image transfer body unit 7 in the shape of an endless belt is wound around a plurality of rollers, and has endless belt shaped intermediate image transfer body 70 which acts as a second image carrying body in the shape of a partially conducting endless belt which is supported in a free manner to rotate.

The images of different colors formed by image forming units 10Y, 10M, 10C, and 10Bk, are successively transferred on to rotating endless belt shaped intermediate image transfer body 70 by primary transfer rollers 5Y, 5M, 5C, and 5Bk acting as the primary image transfer section, thereby forming the synthesized color image. Transfer material P as the transfer material stored inside sheet feeding cassette 20 (the supporting body that carries the final fixed image: for example, plain paper, transparent sheet, etc.,) is fed from sheet feeding means 21, pass through a plurality of intermediate rollers 22A, 22B, 22C, and 22D, and resist roller 23, and is transported to secondary transfer roller 5*b* which functions as the secondary image transfer section, and the color image is transferred in one operation of secondary image transfer on to transfer material P. Transfer material P on which the color image has been transferred is subjected to fixing process by fixing means 24, and is gripped by sheet discharge rollers 25 and placed above sheet discharge tray 26 outside the equipment. Here, the transfer supporting body of the toner image formed on the photoreceptor of the intermediate transfer body or of the transfer material, etc. is comprehensively called the transfer media.

On the other hand, after the color image is transferred to transfer material P by secondary transfer roller 5*b* functioning as the secondary transfer section, endless belt shaped intermediate image transfer body 70 from which transfer material P has been separated due to different radii of curvature is cleaned by cleaning means 6*b* to remove all residual toner on it.

During image forming, primary transfer roller 5Bk is at all times contacting against photoreceptor 1Bk. Other primary transfer rollers 5Y, 5M, and 5C come into contact respectively with corresponding photoreceptors 1Y, 1M, and 1C only during color image forming.

Secondary transfer roller 5*b* comes into contact with endless belt shaped intermediate transfer body 70 only when secondary transfer is to be made by passing transfer material P through this.

Further, chassis 8 can be pulled out via supporting rails 82L and 82R from body A of the apparatus.

Chassis 8 comprises image forming sections 10Y, 10M, 10C, and 10Bk, and endless belt shaped intermediate image transfer body unit 7.

Image forming sections 10Y, 10M, 10C, and 10Bk are arranged in column in the vertical direction. Endless belt shaped intermediate image transfer body unit 7 is placed to the left side in the figure of photosensitive drums 1Y, 1M, 1C, and 1Bk. Endless belt shaped intermediate image transfer body unit 70 comprises endless belt shaped intermediate image transfer body 70 that can rotate around rollers 71, 72, 73, 74 and 76, primary image transfer rollers 5Y, 5M, 5C, and 5Bk, and cleaning means 6*b*.

Figure 3:
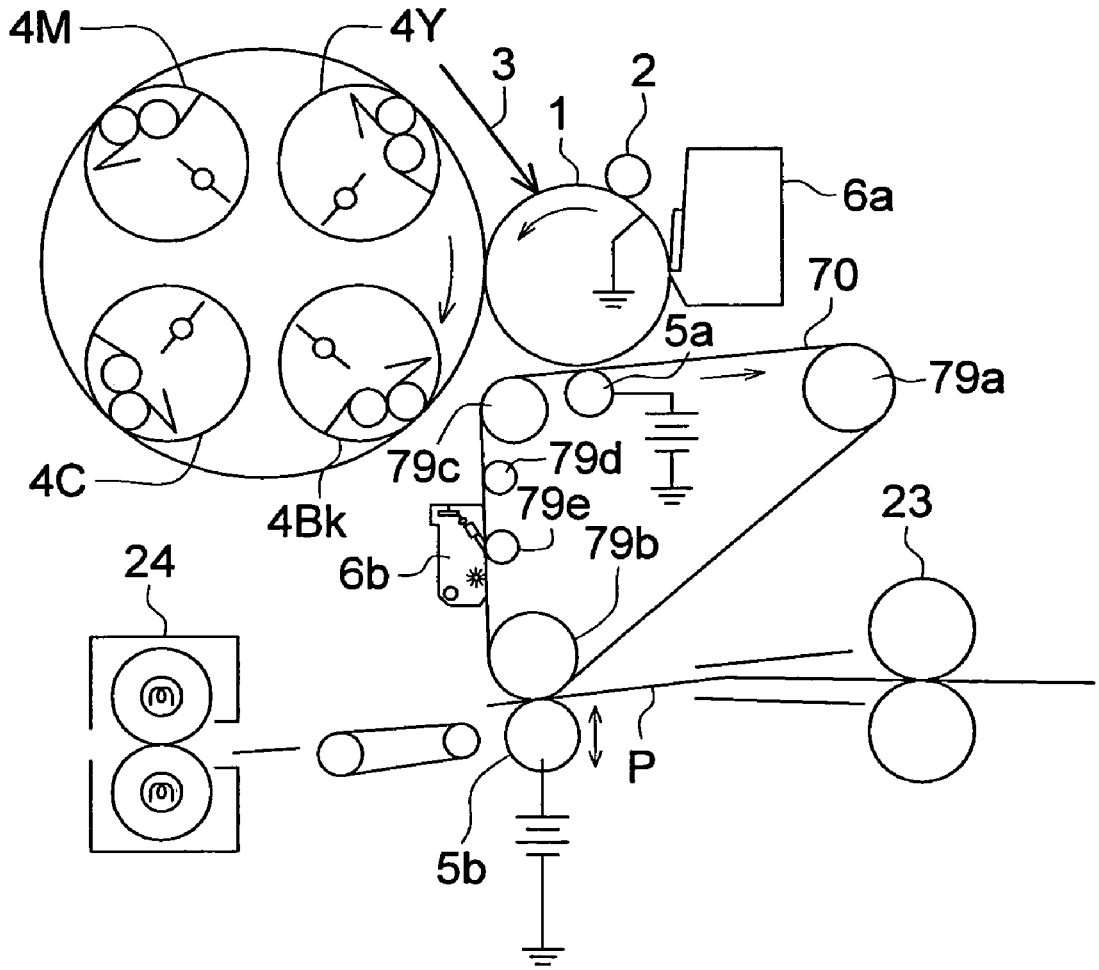
FIG. 3 is a cross-sectional configuration view diagram of a color image forming apparatus using an organic photoreceptor of the present invention.

Next, FIG. 3 shows the cross-sectional configuration view diagram of a color image forming apparatus using an organic photoreceptor of the present invention (a copier or a laser beam printer having at least a charging means, an exposing means, a plurality of developing means, image transfer section, cleaning means, and intermediate image transfer body around the organic photoreceptor). An elastic material with a medium level of electrical resistivity is being used for belt shaped intermediate image transfer body 70.

In this figure, 1 is a rotating drum type photoreceptor that is used repetitively as the image carrying body, and is driven to rotate with a specific circumferential velocity in the anti-clockwise direction shown by the arrow.

During rotation, photoreceptor 1 is charged uniformly to a specific polarity and potential by charging means (charging process) 2, after which it receives from image exposing means (image exposing process) 3 not shown in the figure image exposure by the scanning exposure light from a laser beam modulated according to the time-serial electrical digital pixel signal of the image information thereby forming the electrostatic latent image corresponding to yellow (Y) color component (color information) of the target color image.

Next, this electrostatic latent image is developed by yellow (Y) developing means: developing process (yellow color developer) 4Y using the yellow toner which is the first color. At this time, the second to the fourth developing means (magenta color developer, cyan color developer, and black color developer) 4M, 4C, and 4Bk are each in the operation switched-off state and do not act on photoreceptor 1, and the yellow toner image of the above first color does not get affected by the above second to fourth developers.

Intermediate image transfer body 70 is wound over rollers 79*a*, 79*b*, 79*c*, 79*d*, and 79*e* and is driven to rotate in a clockwise direction with the same circumferential speed as photoreceptor 1.

The yellow toner image of the first color formed and retained on photoreceptor 1 is, in the process of passing through the nip section between photoreceptor 1 and intermediate image transfer body 70, intermediate transferred (primary transferred) successively to the outer peripheral surface of intermediate image transfer body 70 due to the electric field formed by the primary transfer bias voltage applied from primary transfer roller 5*a* to intermediate image transfer body 70.

The surface of photoreceptor 1 after it has completed the transfer of the first color yellow toner image to intermediate image transfer body 70 is cleaned by cleaning section 6*a*.

In the following, in a manner similar to the above, the second color magenta toner image, the third color cyan toner image, and the fourth color black toner image are transferred successively on to intermediate image transfer body 70 in a superimposing manner, thereby forming the superimposed color toner image corresponding to the desired color image.

Secondary transfer roller 5*b* is placed so that it is supported by bearings parallel to secondary transfer opposing roller 79*b* and pushes against intermediate image transfer body 70 from below in a separable condition.

In order to carry out successive overlapping transfer of the toner images of the first to fourth colors from photoreceptor 1 to intermediate image transfer body 70, the primary transfer bias voltage applied has a polarity opposite to that of the toner and is applied from the bias power supply. This applied voltage is, for example, in the range of +100V to +2 kV.

During the primary transfer process of transferring the first to the third color toner image from photoreceptor 1 to intermediate image transfer body 70, secondary transfer roller 5*b* and intermediate image transfer body cleaning means 6*b* can be separated from intermediate image transfer body 70.

The transfer of the superimposed color toner image transferred on to belt shaped intermediate image transfer body 70 on to transfer material P which is the second image supporting body is done when secondary transfer roller 5*b* is in contact with the belt of intermediate image transfer body 70, and transfer material P is fed from corresponding sheet feeding resist roller 23 via the transfer sheet guide to the contacting nip between secondary transfer roller 5*b* and intermediate image transfer body 70 at a specific timing. The secondary transfer bias voltage is applied from the bias power supply to secondary image transfer roller 5*b*. Because of this secondary transfer bias voltage, the superimposed color toner image is transferred (secondary transfer) from intermediate image transfer body 70 to transfer material P which is the second image supporting body. Transfer material P which has received the transfer of the toner image is guided to fixing means 24 and is heated and fixed there.

The image forming method according to the present invention can be applied in general to all electro-photographic apparatuses such as electro-photographic copiers, laser printers, LED printers, and liquid crystal shutter type printers, and in addition, it is also possible to apply the present invention to a wide range of apparatuses applying electro-photographic technology, such as displays, recorders, light printing equipment, printing screen production, and facsimile equipment.

EXAMPLE

Next, the present invention will now be described in detail referring to examples, however, the present invention is not limited thereto. Incidentally, "part" in the description represents "part by weight".

Preparation of Photoreceptor 1

Photoreceptor 1 was produced as follows.

The surface of cylinder type aluminum support was subjected to a cutting process, and a conductive support of 10 points surface roughness Rz=1.5 (μm) was prepared.

<Intermediate Layer>

The following intermediate layer dispersion liquid was diluted twice with the same mixed solvent, and filtered after standing for overnight (filter; NihonPall Ltd. RIGIMESH 5 μm filter, produced by NihonPall, Ltd.), to prepare an intermediate layer coating solution.

| | |
|---|---|
| Polyamide resin CM8000 (produced by Toray Industries, Inc.) | 1 part |
| Inorganic particles: Titanium oxide (the number average primary particle diameter of 35 nm: titanium oxide subjected to a silica•alumina process and a methyl hydrogen polysiloxane process) | 3 parts |
| Methanol | 10 parts |

The above composites were mixed, and dispersed for 10 hours employing a batch type sand mill as a homogenizer to prepare the intermediate layer dispersion solution.

The above-prepared coating solution was coated on the foregoing support so as to become 1.0 μm in dry thickness.

<Charge Generating Layer: CGL>

| | |
|---|---|
| Titanylphthalocyanine pigment (titanylphthalocyanine pigment having a maximum diffraction peak approximately at 27.3° of the Bragg angle (2θ ± 0.2°) by X-ray diffraction spectrum with Cu-Kα characteristic X-rays) | 24 parts |
| Polyvinyl butyral resin "ESLEK BL-1" (produced by Sekisui Chemical Co., Ltd.) | 12 parts |
| 2-butanone/cyclohexanone = 4/1 (v/v) | 300 parts |

The above compositions were mixed, and dispersed employing a sand mill to prepare the charge generating layer coating solution. This coating solution was coated by a dip coating method, and a charge generating layer of 0.5 μm in dry thickness was formed on the foregoing intermediate layer <Charge Transporting Layer 1 (CTL1)>

| | |
|---|---|
| Charge transport material (4,4'-dimethyl-4''-(α-phenyl styryl) triphenylamine) | 225 parts |
| Polycarbonate (Z300: produced by Mitsubishi Gas Chemicals, Inc.) | 300 parts |
| Antioxidant (exemplified compound AO2-1) | 6 parts |
| Dichloromethane | 2000 parts |
| Silicone oil (KF-54, produced by Shin-Etsu Chemical Co., Ltd.) | 1 Part |

The above compositions were mixed and dissolved to prepare charge transporting layer coating solution 1. This coating solution was coated on the foregoing charge generating layer by an immersion coating method, and was subjected to a drying process at 110° C. for 70 minutes to form charge transporting layer 1 having a dry thickness of 18.0 μm.

<Charge Transporting Layer 2 (CTL2)>

| | |
|---|---|
| Charge transport materials (4,4'-dimethyl-4''-(α-phenyl styryl) triphenylamine) | 150 parts |
| Binder: (block copolymer of the foregoing block 1) | 300 parts |
| Antioxidant (exemplified compound AO2-1) | 12 parts |
| THF: Tetrahydrofuran | 1200 parts |
| Silicone oil (KF-54, produced by Shin-Etsu Chemical Co., Ltd.) | 4 parts |

The above compositions were mixed and dissolved to prepare charge transporting layer coating solution 2. This coating solution was coated on foregoing charge transporting layer 1 by a circular slide hopper type coater, and was subjected to a drying process at 110° C. for 70 minutes to form charge transporting layer 2 having a dry thickness of 2.0 μm, and prepare photoreceptor 1.

Preparation of Photoreceptors 2-14

Photoreceptors 2-14 were prepared, similarly to preparation of photoreceptor 1, except that a binder kind of charge transporting layer 2 (CTL2) was changed as shown in Table 2.

Preparation of Photoreceptor 15 photoreceptor 15 was prepared, similarly to preparation of photoreceptor 1, except that block 1 of charge transporting layer 2 in photoreceptor 1 was replaced to the following graft copolymer (GP1).

Graft Polymer (GP1)

Preparation of Photoreceptor 16 photoreceptor 16 was prepared, similarly to preparation of photoreceptor 1, except that block 1 of charge transporting layer 2 of photoreceptor 1 was replaced to an admixture of polycarbonate (Z); Z-300 produced by Mitsubishi Gas Chemicals, Inc. and dimethylpolysiloxane; KF-96 produced by Shin-Etsu Chemical Co., Ltd. (admixture having a content ratio of 100 to 3 by weight).

Measured Results of domain diameter and domain density concerning photoreceptors 1-16 are shown in Table 2.

TABLE 2

| Photo-receptor No. | Binder of CTL2 | Domain diameter (nm) | Domain density (per $1 \times 10^4$ $nm^2$) |
|---|---|---|---|
| 1 | Block 1 | 5 | 9 |
| 2 | Block 2 | 15 | 15 |
| 3 | Block 3 | 30 | 20 |
| 4 | Block 4 | 35 | 13 |
| 5 | Block 5 | 15 | 14 |
| 6 | Block 6 | 32 | 18 |
| 7 | Block 7 | 30 | 12 |
| 8 | Block 8 | 80 | 17 |
| 9 | Block 9 | 60 | 13 |
| 10 | Block 10 | 100 | 10 |
| 11 | Block 11 | 0.8 | 125 |
| 12 | Block 12 | 0.9 | 230 |
| 13 | Block 13 | 0.8 | 200 |
| 14 | Block 14 | 0.5 | 190 |
| 15 | GP1 | No domain formed | No domain formed |
| 16 | Admixture of polycarbonate and polysiloxane | No domain formed | No domain formed |

Incidentally, it is confirmed via IR (infrared) spectrum that an A-B block copolymer is contained in each of surface layers employed for photoreceptors 1-14.

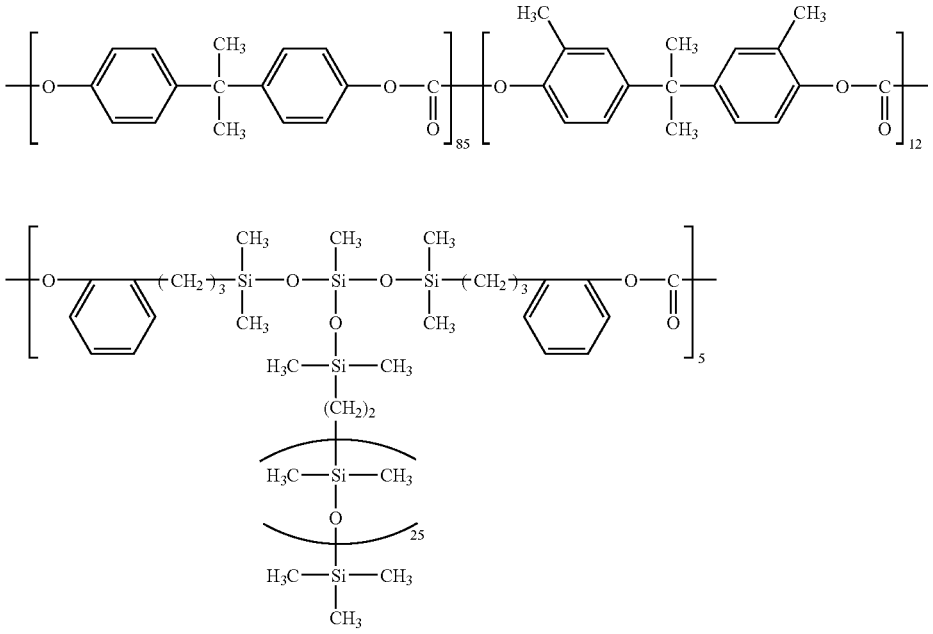

<<Evaluation 1>>

<Practical Picture Evaluation>

The above photoreceptors were mounted in a commercially available full color compound machine 8050 (manufactured by Konica Minolta Business Technologies, Inc.) having a basic structure as shown in FIG. 2, and color image evaluation was conducted.

Evaluation Condition

Line speed of a photoreceptor: 220 mm/sec

<<Image Evaluation>>

Each of photoreceptors was installed in the above full color compound machine 8050, and 10,000 sheets of an A4 size original image including a character image, a white solid image, a black solid image and a halftone image were copied at high-temperature and humidity (30° C. and 80% RH). The following image evaluation was conducted after employing a copied image obtained at the start time and for every 0.1000 copies.

Other Conditions of Image Formation

Process speed: 220 mm/sec

Developer: a two-component developer (Y, M, C and Bk) containing a carrier and a toner was employed.

Cleaning section for photoreceptor: A rubber cleaning blade was used at a linear load of 18 N/m as a contact condition.

Cleaning section for intermediate image transfer body: A rubber cleaning blade was employed.

Toner image reproducibility on a photoreceptor (evaluated with a cyan toner image).

A toner image was evaluated by transferring a toner image on a photoreceptor into a transparent adhesive sheet.

A: no significant hollow defects are generated, whereby a dot image is clearly reproduced. (Excellent)

B: Hollow defects are slightly generated, but a dot image is reproduced. (Practicable)

D: Significant hollow defects are generated, whereby shape of a dot image is deformed. (impracticable)

Toner image reproducibility on an intermediate image transfer body (evaluated with a cyan toner image).

A toner image was evaluated with the transfer image by transferring a toner image on an intermediate image transfer body into a transparent adhesive sheet.

B: no significant hollow defects are generated, whereby a dot image is clearly reproduced. (Good)

C: Hollow defects are slightly generated, but a dot image is reproduced. (Practicable)

D: Significant hollow defects are generated, whereby shape of a dot image is deformed. (impracticable)

(Cleaning Ability)

After the above evaluation, only the linear load of a cleaning blade touching a cleaning blade without replacing the cleaning blade was changed from 18 to 9 N/m, and further 10,000 sheets were continuously copied to evaluate a cleaning ability.

A: Up to 10,000th copy, no insufficient cleaning caused by passing the toner under a cleaning blade occurs.

(Excellent)

B: Up to 10,000th copy, insufficient cleaning caused by passing the toner under a cleaning blade occurs occasionally, but toner filming on a photoreceptor is not observed.

(Available in Practical Use)

D: During printing 10,000 sheets, insufficient cleaning is continuously generated (at least two sheets), or toner filming on a photoreceptor is observed. (Problematic in practical use)

Contact angles of photoreceptors 1-16 were measured at the start time (St) and at the end time (End) before and after the above 10,000 sheet copying evaluation, and the results were shown in Table 3. In addition, the contact angle was measured by the foregoing method. Evaluated results are shown in following Table 3.

TABLE 3

| Photo-receptor | Contact angle (°) | | Toner image reproducibility on a | Toner image reproducibility on an intermediate image transfer | Cleaning |
|---|---|---|---|---|---|
| No. | St | End | photoreceptor | body | ability |
| 1 | 104 | 103 | A | B | A |
| 2 | 104 | 103 | A | B | A |
| 3 | 105 | 102 | A | B | A |
| 4 | 104 | 103 | A | B | A |
| 5 | 104 | 103 | A | B | A |
| 6 | 104 | 103 | A | B | A |
| 7 | 105 | 103 | A | B | A |
| 8 | 95 | 92 | A | B | B |
| 9 | 103 | 95 | A | B | B |
| 10 | 100 | 96 | A | B | B |
| 11 | 92 | 89 | A | C | B |
| 12 | 93 | 88 | A | C | B |
| 13 | 94 | 90 | A | C | B |
| 14 | 94 | 89 | A | C | B |
| 15 | 104 | 85 | A | D | D |
| 16 | 98 | 84 | A | D | D |

As can be seen from Table 3, organic photoreceptors of the present invention having a sea/island structure surface layer, in which domains aggregating a low surface energy component in a binder resin are formed, can result in exhibiting totally excellent characteristics such as toner image reproducibility on the photoreceptor, toner image reproducibility on the intermediate image transfer body, and the cleaning ability. On the other hand, it is obvious that the photoreceptor, in which no domains aggregating a low surface energy component on the surface layer are formed, results a lot of hollow defects, and deteriorated toner image reproducibility on the intermediate image transfer body, accompanied with lowered cleaning ability.

<<Evaluation 2>>

Photoreceptors No. 3 and No. 15 as arranged in FIG. 4 were mounted in a modified machine of a commercially available color printer MAGICOLOR 2300 (manufactured by Konica Minolta Business Technologies, Inc.) having a basic structure as shown in FIG. 3, and the same evaluation items as in evaluation 1 were evaluated.

Results are shown in Table 4.

TABLE 4

| Photoreceptor No. | Contact angle (°) Initialstage | Contact angle (°) After copying 5000 sheets | Toner image reproducibility on a photoreceptor | Toner image reproducibility on an intermediate image transfer body | Cleaning ability |
|---|---|---|---|---|---|
| 3 | 105 | 103 | A | B | A |
| 15 | 104 | 85 | A | D | D |

As can be seen from Table 4, color images obtained via organic photoreceptor No. 3 of the present invention result in exhibiting totally excellent characteristics such as toner image reproducibility on the photoreceptor, toner image reproducibility on the intermediate image transfer body, and the cleaning ability. On the other hand, it is to be understood that color images formed via organic photoreceptor No. 15 result deteriorated toner image reproducibility on the intermediate image transfer body and lowered cleaning ability.

[Effect of the Invention]

By using a process cartridge, an image forming method and an image forming apparatus employing each of photoreceptors 1-14, a dot latent image can be changed to form a precise dot image employing a semiconductor laser, and toner image transferability from a photoreceptor to a transfer medium is improved, whereby not only hollow defects and degradation of dot images are inhibited, but also a cleaning ability is improved to provide electrophotographic images.

What is claimed is:

1. An organic photoreceptor comprising a photosensitive layer having a surface layer, provided on or over a conductive support, wherein the surface layer of the organic photoreceptor contains a block copolymer comprising a matrix component (component A) and a low surface energy component (component B), and comprises a sea/island structure having domains formed by aggregating the low surface energy component in the block copolymer, and wherein the low surface energy component is polysiloxane and a number average molecular weight of the polysiloxane is in a range of 200-20000.

2. The organic photoreceptor of claim 1, wherein a number average primary particle diameter of the domains is in a range of 1-100 nm.

3. The organic photoreceptor of claim 1, wherein the surface layer has a domain density of 1-10000 domains per $1\times10^{-4}$ $nm^2$.

4. The organic photoreceptor of claim 1, wherein the component A is a styrene-acrylic ester copolymer component.

5. The organic photoreceptor of claim 1, wherein the organic photoreceptor comprises an intermediate layer, and the photosensitive layer comprises a charge generating layer and a charge transporting layer, provided on or over the conductive support.

6. The organic photoreceptor of claim 5, wherein the intermediate layer comprises a binder resin containing inorganic particles.

7. The organic photoreceptor of claim 1, wherein the block copolymer is an A-B block copolymer comprising the low surface energy component (component B) at a mono-terminal.

8. The organic photoreceptor of claim 7, wherein the component A is a polycarbonate component.

9. A process cartridge employed for an image forming apparatus comprising an organic photoreceptor, and at least one section of a charging section to charge the organic photoreceptor, a latent image forming section to form an electrostatic latent image on the charged organic photoreceptor, a developing section to visualize the electrostatic latent image to form a toner image, a transfer section to transfer the toner image onto a transfer medium from the organic photoreceptor, a discharging section to eliminate charges remaining on the organic photoreceptor after transferring the toner image, and a cleaning section to remove toner remaining on the organic photoreceptor after transferring the toner image, wherein the organic photoreceptor in which a surface layer of the organic photoreceptor contains a block copolymer comprising a matrix component (component A) and a low surface energy component (component B), and comprises a sea/island structure having domains formed by aggregating the low surface energy component in the block copolymer, and wherein the low surface energy component is polysiloxane and a number average molecular weight of the polysiloxane is in a range of 200-20000;

and at least one section are supported in a cartridge housing as one body capable of being mounted detachably in an image forming apparatus.

10. The process cartridge of claim 9, wherein a number average primary particle diameter of the domains is in a range of 1-100 nm.

11. The process cartridge of claim 9, wherein the block copolymer is an A-B block copolymer comprising the low surface energy component (component B) at a mono-terminal.

12. An image forming apparatus comprising an organic photoreceptor, and at least one section of a charging section to charge the organic photoreceptor, a latent image forming section to form an electrostatic latent image on the charged organic photoreceptor, a developing section to visualize the electrostatic latent image to form a toner image, a transfer section to transfer the toner image onto a transfer medium from the organic photoreceptor, a discharging section to eliminate charges remaining on the organic photoreceptor after transferring the toner image, and a cleaning section to remove toner remaining on the organic photoreceptor after transferring the toner image, wherein employed is the organic photoreceptor in which a surface layer of the organic photoreceptor contains a block copolymer comprising a matrix component (component A) and a low surface energy component (component B), and comprises a sea/island structure having domains formed by aggregating the low surface energy component in the block copolymer, wherein the low surface energy component is polysiloxane and a number average molecular weight of the polysiloxane is in a range of 200-20000.

13. The image forming apparatus of claim 12, wherein a number average primary particle diameter of the domains is in a range of 1-100 nm, and the low surface energy component is polysiloxane.

14. The image forming apparatus of claim 12, wherein the block copolymer is an A-B block copolymer comprising the low surface energy component (component B) at a mono-terminal.

* * * * *